United States Patent [19]

Picot

[11] Patent Number: 4,870,904

[45] Date of Patent: Oct. 3, 1989

[54] RELEASABLE BODY PROVIDED WITH AERODYNAMIC BRAKING MEANS

[75] Inventor: Jacques Picot, Velizy-Villacoublay, France

[73] Assignee: Aerospatiale Societe Nationale Industrielle, Paris, France

[21] Appl. No.: 272,931

[22] Filed: Nov. 18, 1988

[30] Foreign Application Priority Data

Nov. 30, 1988 [FR] France ..... 87 16582

[51] Int. Cl.[4] ..... F42B 25/24; B64D 1/04

[52] U.S. Cl. ..... 102/383; 102/380; 102/387; 102/388

[58] Field of Search ..... 102/393, 386, 387, 388, 102/400, 383, 489, 480, 216

[56] References Cited

U.S. PATENT DOCUMENTS

| | | | |
|---|---|---|---|
| 1,289,702 | 12/1918 | Proper | 102/383 |
| 1,626,363 | 4/1927 | Sperry | 102/387 |
| 2,044,819 | 6/1936 | Taylor | 102/388 |
| 3,228,634 | 1/1966 | Chakoian et al. | 102/388 |
| 3,875,862 | 4/1975 | Fischer et al. | 102/425 |
| 3,948,175 | 4/1976 | Bucklisch | 102/387 |
| 3,978,790 | 9/1976 | Sandelius | 102/388 |
| 4,492,166 | 1/1985 | Purcell | 102/384 |
| 4,691,636 | 9/1987 | Witt et al. | 102/387 |

FOREIGN PATENT DOCUMENTS

| | | | |
|---|---|---|---|
| 1800121 | 4/1970 | Fed. Rep. of Germany . | |
| 3127071 | 7/1981 | Fed. Rep. of Germany . | |
| 3509282 | 9/1986 | Fed. Rep. of Germany . | |
| 715385 | 12/1931 | France | 102/387 |

*Primary Examiner*—David H. Brown

*Attorney, Agent, or Firm*—Fisher, Christen & Sabol

[57] ABSTRACT

This invention relates to a releasable body, comprising outspreadable arms articulated at one of the ends of said body and actuation means adapted to pass said arms, in the course of aerial descent of said body, from a position folded along said body to a spread out position substantially perpendicular to said body in order to brake descent thereof, wherein it comprises first means for controlling said actuation means to control retraction of said arms along said body when the latter has reached the ground after its aerial descent, said body then being in standby state, and second means for controlling said actuation means to control outspreading of said arms to pass from the standby state to an active state in which the arms support the body on the ground. The invention is applied to releasable bodies provided with aerodynamic braking means.

12 Claims, 5 Drawing Sheets

RELEASABLE BODY PROVIDED WITH AERODYNAMIC BRAKING MEANS

The present invention relates to a releasable body provided with aerodynamic braking means.

The releasable body according to the invention may particularly, but not exclusively, constitute a "submunition" adapted to carry a military load (mine, rocket, mini-missile, etc. . .). Such a body might also perform a role of "watch" and, to that end, may comprise means for observation and watching of the site.

In one or the other of these roles, and whether an aerial weapon system (missile, airborne container, etc. . . ) or ground weapon system (container on the ground, on a truck, etc. . . ) is used to that end, the use of such a body involves an aerial phase.

A first problem of aerodynamic braking, in order to minimize the effect of shock upon contact with the ground, is therefore raised. Such an aerodynamic braking is currently obtained with the aid of a parachute, such as for example in U.S. Pat. No. 3,875,862. However, this presents a certain number of drawbacks. In fact, the fabric of the parachute covering said body on the ground may limit the efficiency of the sensors for detecting a potential target and even prevent setting off in the case of a rocket for example, or may blind the means for observation and watching of the site. Furthermore, the rigging lines of the parachute may become stuck in the mobile parts of the body and block operation thereof. Moreover, the spread-out surface of the parachute on the ground is likely to reveal the presence of said body, even if the parachute is ejected upon arrival on the ground or immediately beforehand.

A second problem is thus raised, once the body has reached the ground: camouflage thereof. In addition to the presence of the parachute, certain existing releasable bodies comprise an underframe which, on reaching the ground, supports the body in active position, in which the body is pitched on the ground. Even if no parachute is used, in that case replaced by airbrakes constituted by outspreadable arms articulated at one end of said body (as in U.S. Pat. No. 4,492,166), the body, with its spread out arms, remains easy to locate on the ground.

It is an object of the present invention to avoid these drawbacks.

To that end, the releasable body, of the type comprising outspreadable arms articulated at one of the ends of said body and actuation means adapted to pass said arms, in the course of aerial descent of said body, from a position folded along said body to a spread out position substantially perpendicular to said body in order to brake descent thereof, is noteworthy in that it comprises first means for controlling said actuation means to control retraction of said arms along said body when the latter has reached the ground after its aerial descent, said body then being in standby state, said second means for controlling said actuation means to control outspreading of said arms to pass from the standby state to an active state in which the arms support the body on the ground.

The outspreadable arms thus perform two essential functions:

during aerial descent, they make it possible to brake the body in order not to risk damaging its different component elements when it reaches the ground;

on the ground, they may be used as support for said body in the active state, after passage through a standby state in which said arms are folded along the body, this facilitating camouflage thereof.

In folded position, said arms advantageously extend over substantially the whole length of said body, in order thus to facilitate straightening up of the body on the ground in the active state.

In particular, the body comprises three arms disposed at 120° with respect to one another.

Between each pair of adjacent arms, there is advantageously provided a skin of supple material. Said skin performs the role of parachute during aerial descent of the body and, furthermore, in the state of standby of the body on the ground (arms folded), said skin surrounding the body may serve as camouflage and as protection against bad weather therefor.

According to another feature of the invention, said actuation means comprise a motor capable of driving an endless screw meshing with a toothed wheel provided at the hinged end of each of said arms.

According to a further feature of the invention, said actuation means comprise a motor capable of driving an endless screw cooperating with a nut on which is mounted the hinged end of each of said arms.

Furthermore, the second control means are adapted to control retraction of said arms to pass from the active state to the standby state.

According to further features of the invention, said first control means may comprise at least one sensor adapted to detect the contact of said body with the ground, and said second control means may comprise at least one sensor adapted to detect the presence of a potential target.

The body comprises at least one sensor for detecting release thereof in order to control outspreading of the arms after release.

Furthermore, said body may comprise a projectile provided with a military load and/or means for observation and watching of the site.

The invention will be more readily understood on reading the following description with reference to the accompanying drawings, in which:

FIG. 1 is a schematic view of the releasable body, comprising aerodynamic braking means, according to the invention.

FIGS. 2 to 7 schematically illustrate the different phases of use of the releasable body of FIG. 1.

FIG. 8A shows the embodiment of FIG. 8 with a military projectile load.

FIG. 9A is a side view of FIG. 8A.

In the Figures, identical references designate like elements.

Figure 1:
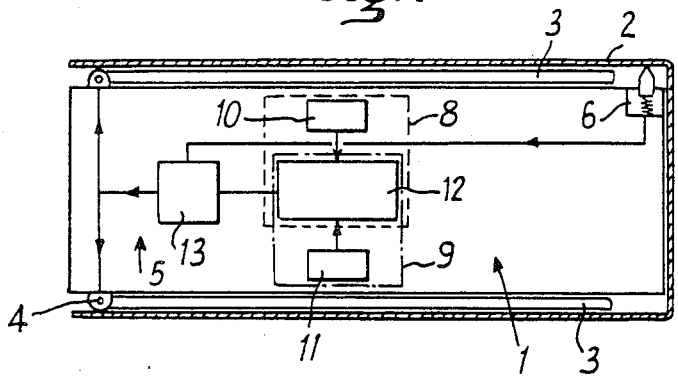
Figure 2:
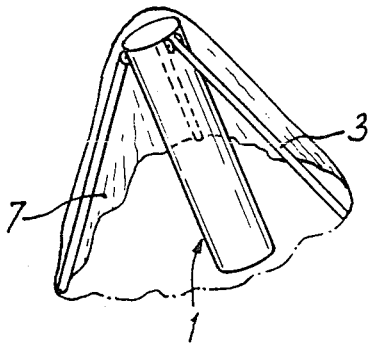
Figure 3:
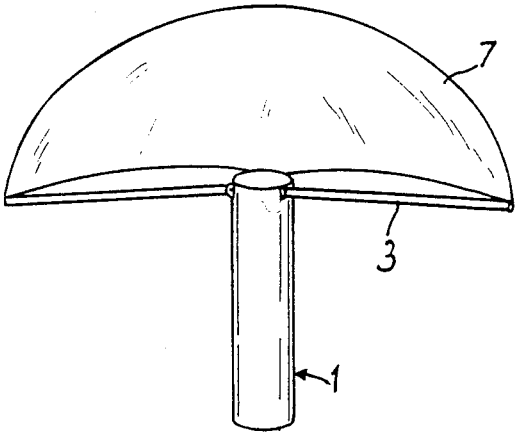

Referring now to the drawings, FIG. 1 shows the body 1 of the invention, adapted to be released, for example from an aircraft, which is housed, before release, in a container 2 open at one end, and comprises aerodynamic braking means. These latter are constituted by outspreadable arms 3, articulated at 4 on one of the ends of the body 1. Furthermore, the body 1 comprises actuation means 5, described in greater detail hereinafter, adapted in particular to pass arms 3, during aerial descent of the body 1, from a position folded along the body (FIG. 1) to an outspread position substantially perpendicular to said body (FIG. 3) in order to brake the descent of the latter. To that end, there is provided a sensor 6 for detecting the release, for example a finger, disposed radially with respect to the axis of ejection of the body, which may move when the body 1 is released from its container 2. Immediately after release of body 1, the arms 3, three in number, disposed at 120° with respect to one another in the example shown, begin to spread out (FIG. 2) under the action of actuation means 5. As shown, a skin 7 of supple material, fixed to the free end of the arms 3, may be provided between each pair of adjacent arms, which skin performs the role of parachute. Another possibility consists in using the arms 3 as rotary wing in order to brake the aerial descent of the body 1. In that case, the arms 3 are profiled so as to form, once outspread, the blades of a rotor whose rotation ensures aerodynamic braking of the body.

Figure 4:
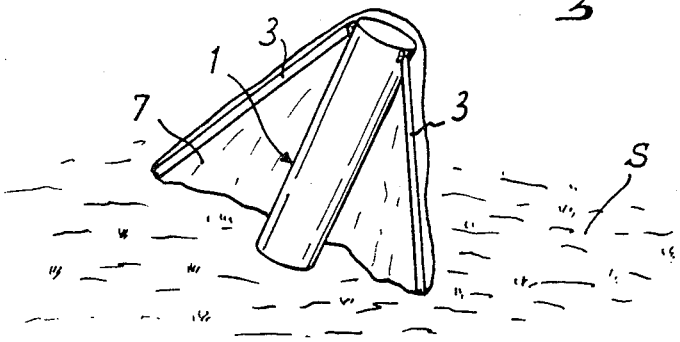
Figure 5:
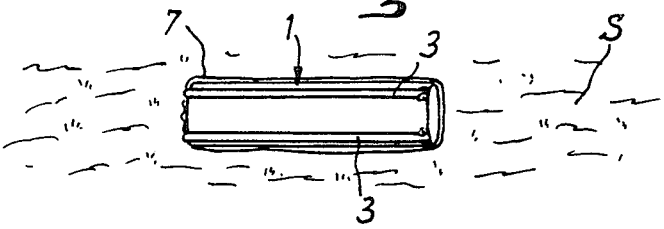
Figure 6:
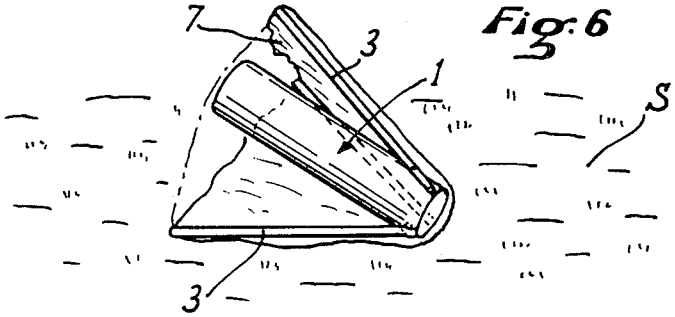
Figure 7:
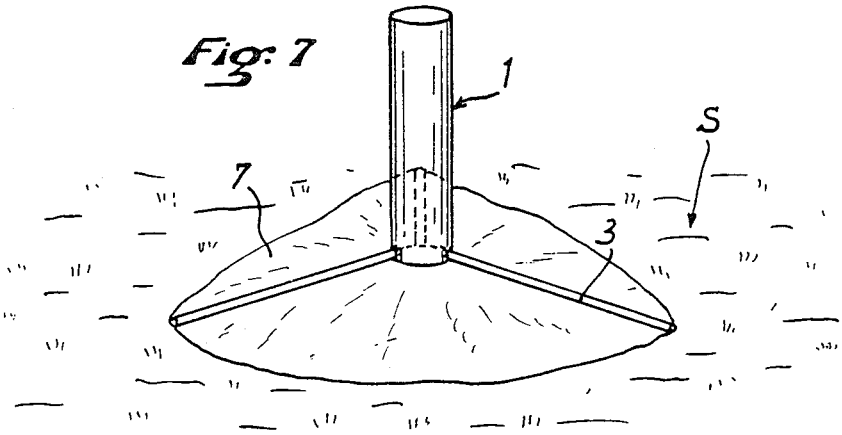

Moreover, the body 1 comprises first means 8 for controlling the actuation means 5 to control retraction of the arms 3 along the body 1 when the latter has reached the ground S after its aerial descent (FIG. 4), the body 1 being in a state of standby when the arms 3 are in completely folded position (FIG. 5). In addition, second means 9 for controlling the actuation means 5 are provided to control outspreading of the arms 3 (FIG. 6) to pass from the state of standby to an active state in which the arms 3 support the body 1 on the ground S (FIG. 7). Furthermore, the second control means 9 may be adapted to control retraction of the arms 3 to pass from the active state (FIG. 7) to the state of standby (FIG. 5).

It will be noted that, in folded position, the arms 3 advantageously extend over substantially the whole length of the body 1. In the state of standby, this makes it possible to completely camouflage the body 1 with the aid of the skins 7. Moreover, this guarantees straightening up of the body 1 to pass from the state of standby to the active state.

More precisely, the first control means 8 comprise at least one sensor 10 adapted to detect the contact of the body 1 with the ground S, for example a shock detector, whilst the second control means 9 comprise at least one sensor 11 adapted to detect the presence of a potential target. Several possibilities may be envisaged for this or these sensors 11, depending on the use envisaged for the body 1. For example, the following may be used, alone or in combination:

an acoustic sensor system associated with a processing of the signal to recognize the presence of targets;

an infrared sensor allowing observation and aiming of a system of aggression (anti-tank rocket);

the association of a camera operating in the visible light or in the infrared and of a millimetric radar, the body 1 performing, in that case, the role of watch.

Furthermore, processing of the different information and use of the control means may be effected in a logic unit 12 shared by the first and second control means 8 and 9. Remote control of said means may also be envisaged.

FIGS. 8 to 13 illustrate in greater detail embodiments of the body 1 of the invention.

As shown, the body 1, in the active state, may rest on the free ends of arms 3, performing the role of tripod, raising the body 1 above the ground. The arms may also be applied on the ground over the whole of their length.

Figure 12:
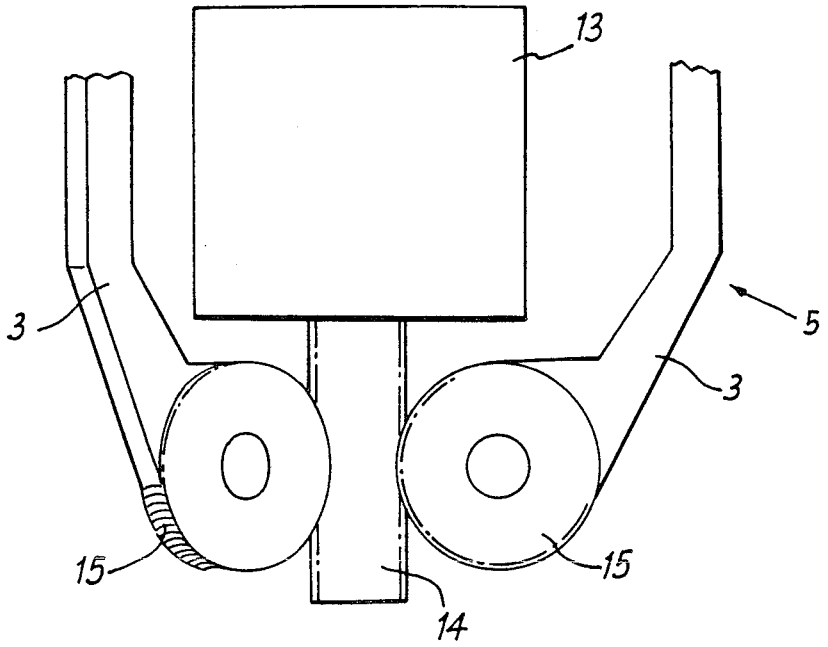
FIGS. 12 and 13 illustrate different means for actuating the arms of the releasable body of the invention.

As shown in FIG. 12, the actuation means 5 may comprise a motor 13, for example electric, capable of driving an endless screw 14 meshing with a toothed wheel 15 provided at the hinged end of each of the arms 3.

Figure 13:
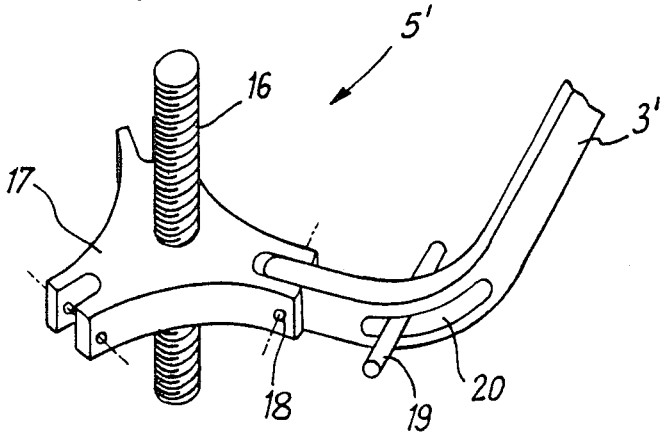

According to another embodiment shown in FIG. 13, the actuation means 5' may comprise a motor (not shown) capable of driving an endless screw 16, cooperating with a nut 17 on which is mounted, at 18, the hinged end of each of the arms 3', the displacement of the arms 3' being, furthermore, obtained thanks to a bar 19, passing through a slot 20 provided at said end of the arm 3', fast with the body 1.

The bodies 1 of the embodiments shown in FIGS. 8, 9 and 10, 11 comprise at least one projectile provided with a military load and/or means for observation and watching of the site 21, mounted, in articulated manner, on a stirrup-shaped piece 22 adapted to take at least two positions, namely parallel to the longitudinal axis X—X' of the body 1 and perpendicular thereto.

As already indicated, a skin 7 performing the role of parachute may be provided between each pair of adjacent arms 3 (FIGS. 10 and 11), or the arms 3 may be shaped as blades 23 (FIGS. 8 and 9) and perform the role of rotary wing.

Figure 9:
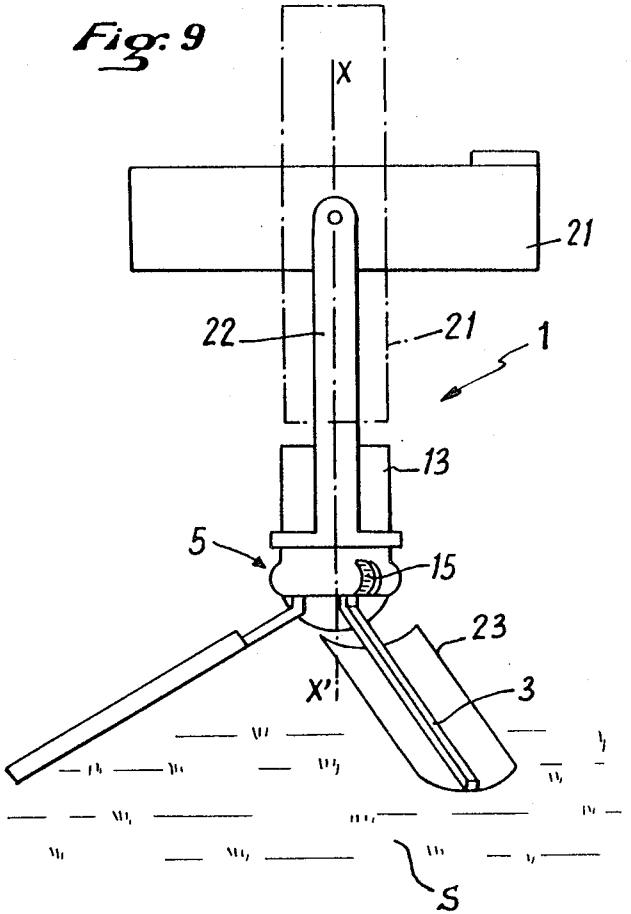
FIG. 9 is a side view of FIG. 8.
Figure 8:
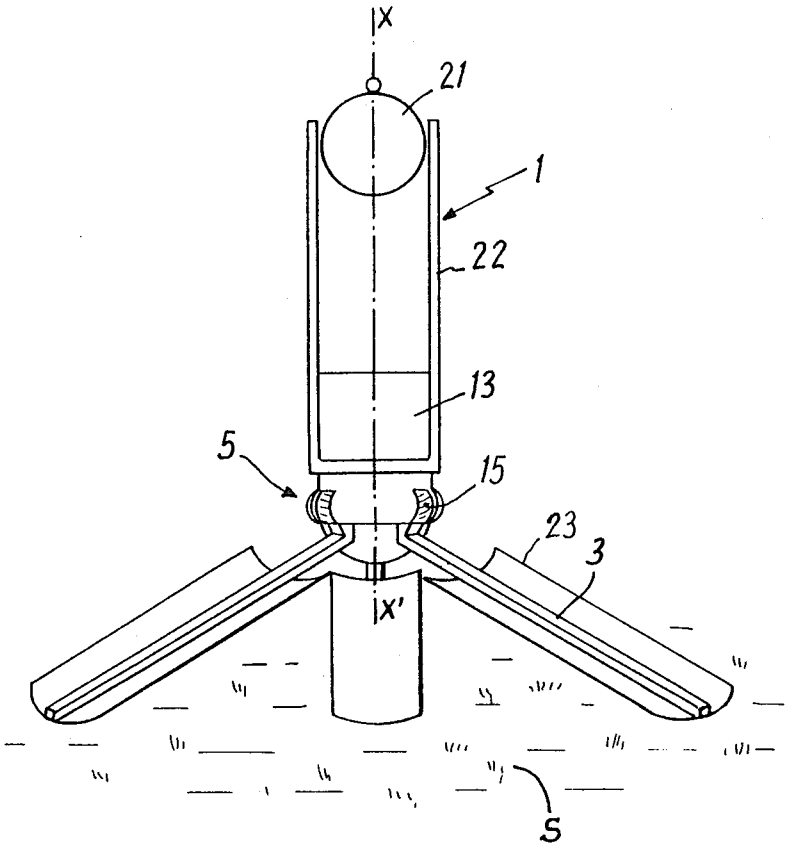
FIG. 8 is a front view of an embodiment of the releasable body according to the invention, in the active state on the ground.
Figure 11:
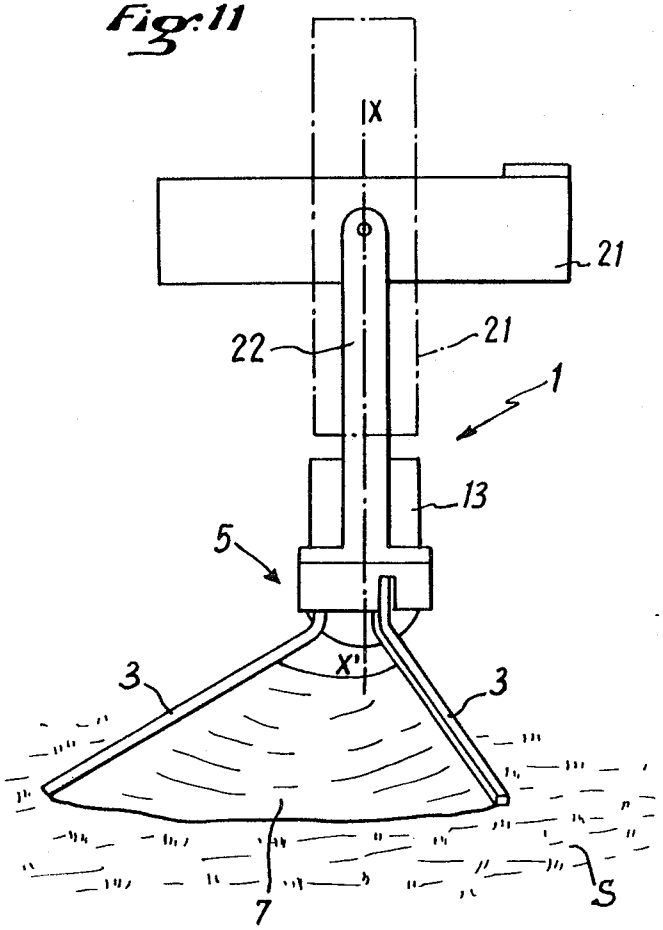
FIG. 11 is a side view of FIG. 10.
Figure 10:
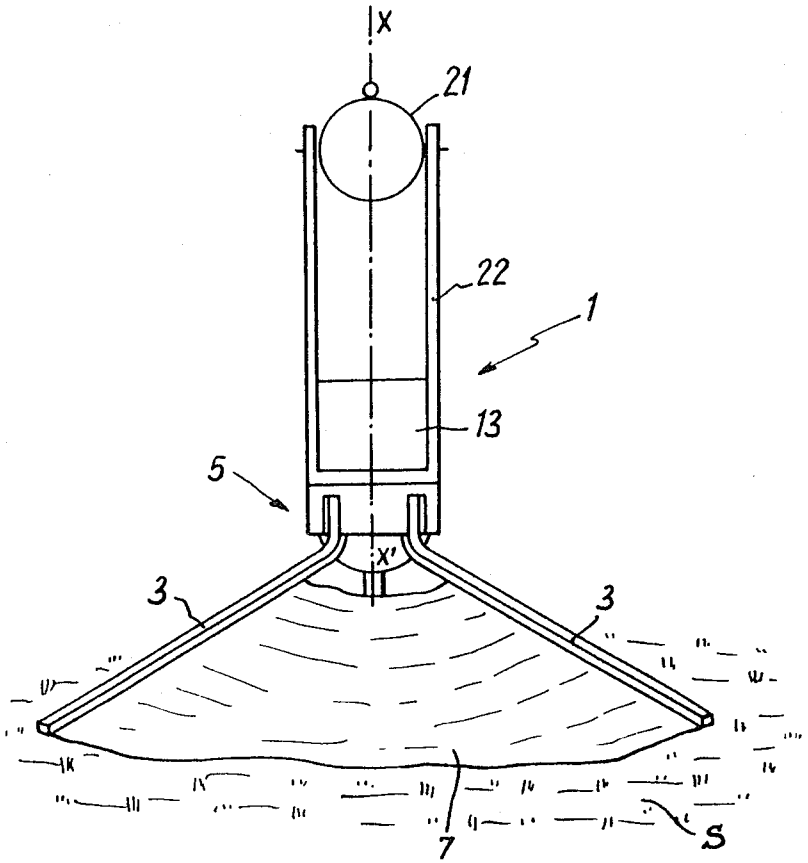
FIG. 10 is a front view of another embodiment of the releasable body according to the invention, in the active state on the ground.

Furthermore, the body of FIGS. 8 and 9 has been shown, by way of example, provided with the actuation means 5 of FIG. 12, and the body of FIGS. 10 and 11 with those of FIG. 13.

In summary, immediately after the body of the invention has been released from an aircraft, or withdrawn from a container on the ground, its arms spread out to ensure aerodynamic braking thereof, in one or the other of the two manners indicated hereinabove; then, once on the ground, the arms fold along the body and, if necessary, the skin or fabric, appropriately treated, may cover it entirely, camouflaging it and protecting it from bad weather. The body is then in a state of standby. When, with the aid of the sensors indicated above, it perceives for example vibrations provoked by the arrival of a tank, the body passes into a state of alert, or active state, in the following manner: the arms spread out up to a position such that they serve as tripod, and the body is in a position for shooting and waits. If the detected tank arrives within its range, the projectile is shot. If, on the other hand, the tank moves away or passes out of range, the arms fold back and the body resumes a state of standby.

What is claimed is:

1. A releasable body, of the type comprising outspreadable arms articulated at one of the ends of said body and actuation means adapted to pass said arms, in the course of aerial descent of said body, from a position folded along said body to a spread out position substantially perpendicular to said body in order to brake descent thereof, wherein it comprises first means for controlling said actuation means to control retraction of said arms along said body when the latter has reached the ground after its aerial descent, said body then being in standby state, and second means for controlling said actuation means to control outspreading of said arms to pass from the standby state to an active state in which the arms support the body on the ground.

2. The releasable body of claim 1, wherein, in folded position, said arms extend over substantially the whole length of said body.

3. The releasable body of claim 1, wherein it comprises three arms disposed at 120° with respect to one another.

4. The releasable body of claim 1, wherein, between each pair of adjacent arms, there is provided a skin of supple material.

5. The releasable body of claim 1, wherein said actuation means comprise a motor capable of driving an endless screw meshing with a toothed wheel provided at the hinged end of each of said arms.

6. The releasable body of claim 1, wherein said actuation means comprise a motor capable of driving an endless screw cooperating with a nut on which is mounted the hinged end of each of said arms.

7. The releasable body of claim 1 wherein said second control means are of the reciprocable type, permitting the retraction of said arms to pass from the active state to the standby state.

8. The releasable body of claim 1, wherein said first control means comprise at least one sensor adapted to detect the contact of said body with the ground.

9. The releasable body of claim 1, wherein said second control means comprise at least one sensor adapted to detect the presence of a potential target.

10. The releasable body of claim 1, further including at least one sensor for detecting release of said body.

11. The releasable body of claim 1, wherein it comprises at least one projectile provided with a military load.

12. The releasable body of claim 1, further including means for observation and watching of the site.

* * * * *